US010128070B2

(12) United States Patent
Zhou et al.

(10) Patent No.: US 10,128,070 B2
(45) Date of Patent: Nov. 13, 2018

(54) CONTACT FOR A HIGH-VOLTAGE VACUUM ARC EXTINGUISHING CHAMBER

(71) Applicant: ZHEJIANG ZIGUANG ELECTRIC APPLIANCE CO., LTD, Zhejiang (CN)

(72) Inventors: Heming Zhou, Taizhou (CN); Zhiyuan Liu, Taizhou (CN); Haiyong Lin, Taizhou (CN)

(73) Assignee: Zhejiang Ziguang Electric Appliance Co., Ltd., Taizhou (CN)

( * ) Notice: Subject to any disclaimer, the term of this patent is extended or adjusted under 35 U.S.C. 154(b) by 29 days.

(21) Appl. No.: 15/109,659

(22) PCT Filed: Mar. 18, 2014

(86) PCT No.: PCT/CN2014/073583
§ 371 (c)(1),
(2) Date: Jul. 5, 2016

(87) PCT Pub. No.: WO2015/106487
PCT Pub. Date: Jul. 23, 2015

(65) Prior Publication Data

US 2016/0329180 A1 Nov. 10, 2016

(30) Foreign Application Priority Data

Jan. 20, 2014 (CN) ..... 2014 1 0025353

(51) Int. Cl.
*H01H 33/664* (2006.01)

(52) U.S. Cl.
CPC ..... *H01H 33/664* (2013.01); *H01H 33/6645* (2013.01); *H01H 33/6644* (2013.01)

(58) Field of Classification Search
CPC ..... H01H 33/66207; H01H 33/664; H01H 33/6645; H01H 33/66; H01H 33/6644
(Continued)

(56) References Cited

U.S. PATENT DOCUMENTS 4,260,864 A * 4/1981 Wayland ..... H01H 33/6644 218/129
4,584,445 A * 4/1986 Kashiwagi ..... H01H 1/0203 200/265
(Continued)

FOREIGN PATENT DOCUMENTS

CN 1132921 A 10/1996
CN 1373485 A 10/2002
(Continued)

OTHER PUBLICATIONS

International Search Report of PCT/CN2014/073583.

*Primary Examiner* — Edwin A. Leon
*Assistant Examiner* — William Bolton
(74) *Attorney, Agent, or Firm* — Minder Law Group; Willy H. Wong

(57) ABSTRACT

The invention provides a contact for a high-voltage vacuum arc extinguishing chamber. The contact of the invention includes a conductive connecting piece, an annular outer contact and an inner contact which is located within the ring of the outer contact and does not contact with the outer contact. The conductive connecting piece, inner contact and outer contact are coaxial and the contact surface of the inner contact is on the same plane as that of the outer contact. The outer contact is fixed on the conductive connecting piece. An axial magnetic field means is covered outside of the conductive connecting piece for generating an axial magnetic field. The axial magnetic field means is fixedly connected with the conductive connecting piece. The inner contact is fixed on the conductive connecting piece. A circumferential magnetic field means is covered outside of the conductive connecting piece for generating a circumferential magnetic field.

9 Claims, 4 Drawing Sheets

(58) Field of Classification Search
USPC ..... 218/118, 123, 139, 146, 126–129, 138
See application file for complete search history.

(56) References Cited

U.S. PATENT DOCUMENTS

| | | | | |
|---|---|---|---|---|
| 5,763,848 | A * | 6/1998 | Hakamata | H01H 33/6643 218/128 |
| 6,080,952 | A * | 6/2000 | Okutomi | H01H 33/6644 218/118 |
| 7,906,742 | B2 * | 3/2011 | Steffens | H01H 33/6642 218/126 |
| 8,198,562 | B2 * | 6/2012 | Bodenstein | H01H 1/50 218/138 |
| 2013/0075369 | A1 | 3/2013 | Li et al. | |
| 2013/0220977 | A1 * | 8/2013 | Gentsch | H01H 33/12 218/123 |

FOREIGN PATENT DOCUMENTS

| | | | |
|---|---|---|---|
| CN | 1688007 | A | 10/2005 |
| CN | 2747700 | Y | 12/2005 |
| CN | 201508801 | U | 6/2010 |
| CN | 103367024 | A | 10/2013 |
| EP | 2551878 | A1 | 1/2013 |

* cited by examiner

CONTACT FOR A HIGH-VOLTAGE VACUUM ARC EXTINGUISHING CHAMBER

RELATED APPLICATIONS

This application is a national stage entry of International Application No. PCT/CN2014/073583, filed Mar. 18, 2014, and claims benefit of Chinese Patent Application No. CN201410025353.7, filed Jan. 20, 2014.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of the vacuum arc extinguishing chamber, and particularly to a contact for a high-voltage vacuum arc extinguishing chamber.

Related Art

In electric power systems, the switching of the high-voltage circuit has to be achieved by the high-voltage vacuum arc extinguishing chamber. The high-voltage vacuum arc extinguishing chamber includes a fixed contact and a moving contact positioned in the vacuum chamber. The electric charge flows from the moving contact to the fixed contact to turn on the high-voltage circuit when the moving contact is in contact with the fixed contact. The high-voltage circuit will be turned off when the moving contact is disconnected with the fixed contact. The electric arc would occur every time the contacts are disconnected, which will extinguish quickly in the vacuum environment. However, if the voltage is in the level of 50 kv or 110 kv, the electric arc is extremely difficult to extinguish in vacuum.

With increase of the number of switching, the electric arc generated in the high-voltage state will continuously burn the contacts, leading to the wear and aging of the contacts, which further increases the contact resistance between the contacts. The housing for forming the vacuum chamber in the vacuum arc extinguishing chamber is generally made of materials like ceramic, glass or epoxy resin, for insulating purposes. However, these materials have a poor heat dissipation property and high heat will be generated in the vacuum chamber by the heat of electric arc and increase of the contact resistance between the contacts. To this end, the use performance and use life of the vacuum arc extinguishing chamber and components thereof will be seriously affected, and the application level and switching capacity of the high-voltage vacuum arc extinguishing chamber will be affected as well.

Upon search, a patent document entitled as "Double Contacts for Vacuum Arc extinguishing chamber", which was published on Oct. 23, 2013 and in the number of CN 103367024A, was located. This patent application discloses two contact bodies in the description, each of which includes a primary contact mounted on the primary contact seat and a secondary contact mounted on the secondary contact seat.

The secondary contact seat is located within the primary contact seat and could move relative to the primary contact seat. A spring is provided between the primary contact seat and the secondary contact seat. Each primary contact faces to the secondary contact and could be engaged or disengaged with the secondary contact. The principle of operation is so configured that the primary contact will be firstly opened and the secondary contact will then be opened when the vacuum arc extinguishing chamber is switched off; and the primary contact will be firstly closed and the secondary contact will then be closed when the vacuum arc extinguishing chamber is switched on. Even though such a configuration could reduce the contact resistance, the circuit break in high-voltage environment could not be addressed, and the electric arc could not rapidly extinguish in high-voltage environment to reduce burning of the contacts by the electric arc.

SUMMARY OF THE INVENTION

In order to address the existing problems of the prior art, the present invention discloses a contact for a high-voltage vacuum arc extinguishing chamber. As such, the electric arc could rapidly extinguish in the high-voltage environment and the heat of the vacuum chamber could be reduced by the invention.

The present invention discloses a contact for a high-voltage vacuum arc extinguishing chamber, comprising a conductive connecting piece, an annular outer contact and an inner contact which is located within the ring of the outer contact and does not contact with the outer contact. The conductive connecting piece, inner contact and outer contact are coaxial and the contact surface of the inner contact is on the same plane as that of the outer contact. The outer contact is fixed on the conductive connecting piece. An axial magnetic field means is covered outside of the conductive connecting piece for generating an axial magnetic field. The axial magnetic field means is fixedly connected with the conductive connecting piece. The inner contact is fixed on the conductive connecting piece. A circumferential magnetic field means is covered outside of the conductive connecting piece for generating a circumferential magnetic field.

The contact for the high-voltage vacuum arc extinguishing chamber of the invention could be used as a moving contact or a fixed contact. The principle of operation of the contact for the high-voltage vacuum arc extinguishing chamber of the invention is mentioned as follows. The contact surface between the contacts could be increased by using the outer contact and inner contact, which shares a part of the current and reduces the heat generated by the contacts. Secondly, an axial magnetic field is generated by the axial magnetic field means when the vacuum arc extinguishing chamber is closed or opened. A circumferential magnetic field having the axis of the conductive connecting piece as the center, is generated by the circumferential magnetic field means. The axial magnetic field covers the outer contact and the inner contact in the meantime. Thanks to the axial magnetic field, the electric arc generated between the moving contact and the fixed contact in the vacuum arc extinguishing chamber will rapidly extinguish in the direction of the magnetic field by means of the magnetic field. Particularly, the electric arc on the contact surface of the outer contact will quickly extinguish. The electric arc produced close to the inner contact will move along the circumferential direction and rapidly extinguish by means of the circumferential magnetic field. As such, the electric arc between the contacts will rapidly extinguish under the intersectional action of the axial and circumferential magnetic fields. The rapid extinction of the high-voltage electric arc further reduces burning of the contacts by the electric arc, thereby reducing the heat of the vacuum chamber.

In the contact for the high-voltage vacuum arc extinguishing chamber of the invention, the said axial magnetic field means includes a first half ring and a second half ring which is on the same axis as first half ring. The first half ring has a first end and a second end, and the second half ring has a third end and a fourth end. The first end is connected with the conductive connecting piece. The second end is connected to the third end through a connecting block. The first half ring and the second half ring are located on the side back to the contact surface of the outer contact. As the first half ring is coaxial with the second half ring, these two annular rings form a coil via the connecting block. An axial magnetic field will be produced after the current flows through the coil. The first half ring and second half ring are located on the side back to the contact surface of the outer contact, so that the axial magnetic line could concentrate on the contact surface of the outer contact, further increasing the arc extinguishing capacity of the outer contact.

In the contact for the high-voltage vacuum arc extinguishing chamber of the invention, the first end has a connecting tube extending to the axis, and the second half ring has a support section extending to the axis. A support cover is placed on the support section. The outer contact is fixed on the support cover. A conductive sleeve is located between the connecting tube and the support cover. The conductive connecting piece is inserted and fixed into the connecting tube. The connecting tube, support cover and conductive sleeve are coaxial. The outer contact is connected to the conductive connecting piece via the support cover, conductive sleeve and connecting tube, so that the outer contact could sustain a large collision force when two contacts are in contact and the axial magnetic field means would not be affected by collision.

In the contact for the high-voltage vacuum arc extinguishing chamber of the invention, a reinforcing plate is fixed on the conductive connecting piece. The reinforcing plate has an outer circumference supported on the first half ring and a flange engaged with the first half ring. The inner circumference of the reinforcing plate is supported on the connecting tube.

In the contact for the high-voltage vacuum arc extinguishing chamber of the invention, the circumferential magnetic field means includes a support frame fixed on the conductive connecting piece and several horseshoe cores placed in the support frame. The horseshoe cores are stacked in the axial direction, and the horseshoe cores are covered outside of the conductive connecting piece and have a spacing from the conductive connecting piece. After a large amount of current flows through the conductive connecting piece, a circumferential magnetic field centered on the axis of the conductive connecting piece will be generated. The circumferential magnetic forces, after being reinforced by the horseshoe cores, will form an oriented circumferential magnetic field which acts on the high-voltage electric arc around the inner contact. The stack of the cores could prevent a vortex magnetic field being produced within the magnetic conductive piece.

In the contact for the high-voltage vacuum arc extinguishing chamber of the invention, the openings of the horseshoe cores are aligned with each other.

In the contact for the high-voltage vacuum arc extinguishing chamber of the invention, the openings of adjacent horseshoe cores are stacked in the same angle and in the same direction. Such an arrangement could increase the arc extinguishing speed.

In the contact for the high-voltage vacuum arc extinguishing chamber of the invention, the openings of a half of the horseshoe cores are aligned on the upper layer and those of the other half are aligned on the lower layer. The openings of the upper layer of the horseshoe cores are arranged normal to those of the lower layer of the horseshoe cores.

In a second embodiment of the circumferential magnetic field means, in the contact for the high-voltage vacuum arc extinguishing chamber of the invention, the circumferential magnetic field means includes a support frame fixed on the conductive connecting piece and several magnetic conductive sheets placed in the support frame. The magnetic conductive sheets are bent into horseshoe shapes the sizes of which are gradually reduced and are stacked in the radial direction of the conductive connecting piece. The horseshoe magnetic conductive sheets are covered outside of the conductive connecting piece and have a spacing from the conductive connecting piece. The circumferential magnetic field means thus configured has a stronger magnetic field in the opening direction and has a quicker arc extinguishing effect.

In the contact for the high-voltage vacuum arc extinguishing chamber of the invention, the support frame includes an outer round tube and inner round tube made of aluminum. A bottom plate is located at the bottom of the outer round tube. A cavity is formed between the outer round tube and the inner round tube to stack the horseshoe cores. The bottom plate is fixed on the conductive connecting piece. The lower end of the inner round tube is fixed on the bottom plate and the upper end thereof is fixed on the conductive connecting piece.

In the contact for the high-voltage vacuum arc extinguishing chamber of the invention, a shield case is fixed on the conductive connecting piece.

In the contact for the high-voltage vacuum arc extinguishing chamber of the invention, the shield case has an inward flange.

In the contact for the high-voltage vacuum arc extinguishing chamber of the invention, the conductive connecting piece includes a conductive post, a column-like conductive body and a column-like conductive block. An inner hole is provided at one end of the conductive body, into which the conductive post is inserted. The conductive body is connected with the conductive block. The conductive post, conductive body and conductive block are coaxial after being connected.

Compared with the prior art, the contact for the high-voltage vacuum arc extinguishing chamber of the invention has the following advantages.

First, the outer and inner contacts employed in the invention reduce the heat of the complete contact generated by increase of the resistance, which prolongs the use life of the high-voltage vacuum arc extinguishing chamber.

Second, the axial magnetic field is generated on the outer contact and most of the axial magnetic field is distributed over the contact surface of the outer contact. To this end, the electric arc on the outer contact could extinguish as soon as possible, which reduces burning of the contact by the electric act and prolongs the use life thereof. Meanwhile, the circumferential magnetic field is generated within the outer magnetic field. The electric arc produced on the inner contact rapidly revolves in the circumferential direction at a speed as high as 70 meters per second and thus rapidly extinguishes. As these two magnetic fields are overlapped across, the switching capacity of the high-voltage vacuum arc extinguishing chamber has been enhanced by 20~25%.

Third, the outer and inner contacts in the invention are directly connected with the conductive connecting piece. The force will not directly act on the axial and circumferential magnetic field means when the contacts are closed and in collision. As such, the invention provides a firm overall structure and a long use life.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The technical solutions of the invention are further described in the embodiments of the invention with reference to the accompanying figures. However, the invention is not limited to these embodiments.

First Embodiment

Figure 1:
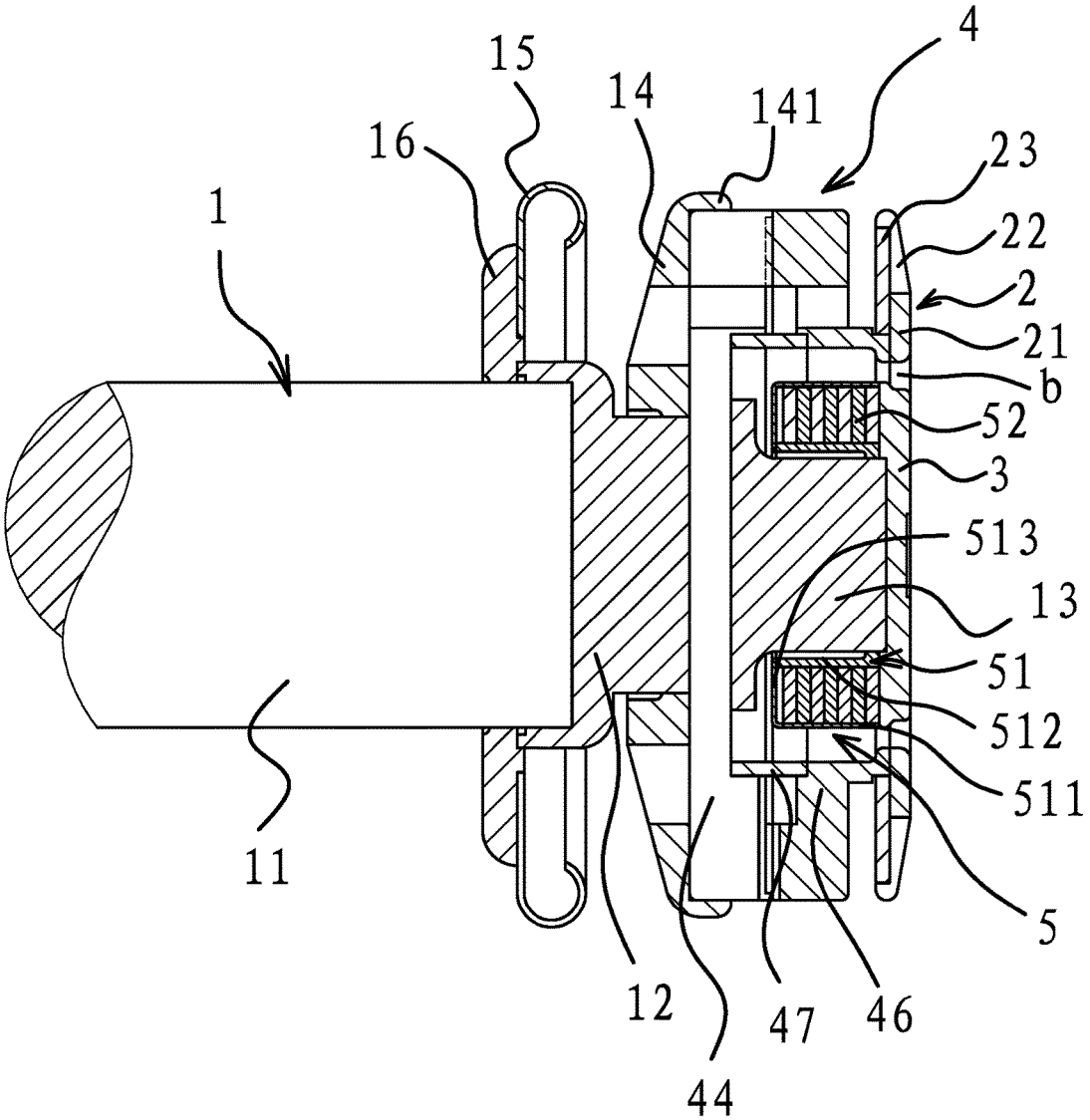
FIG. 1 is a section view of the contact for the high-voltage vacuum arc extinguishing chamber according to the first embodiment of the invention.

As shown in FIG. 1, the contact for the high-voltage vacuum arc extinguishing chamber of the invention could be used as a moving contact or a fixed contact, including a conductive connecting piece 1, an annular outer contact 2 and an inner contact 3 which is located within the ring of the outer contact 2 and does not contact with the outer contact 2. The electric arc could rapidly extinguish in high-voltage environment and the heat in the vacuum chamber is reduced by using the contact of the invention.

Figure 2:
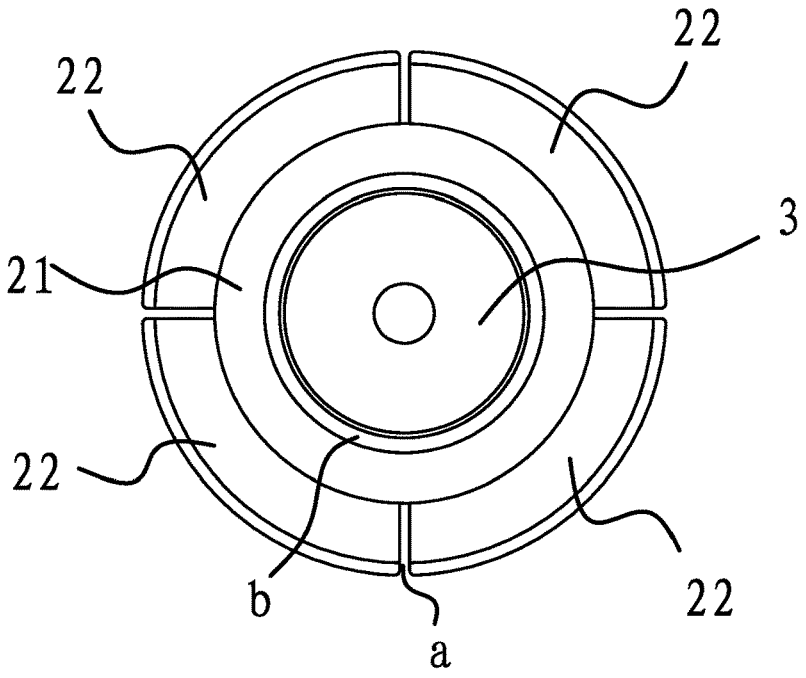
FIG. 2 is a top view of the outer contact and inner contact of FIG. 1.

In particular, referring to FIGS. 1 and 2, the outer contact 2 is annual and the intermediate portion 21 is made of copper-chromium alloy materials. Four sector pieces 22 are provided on the edge of the intermediate portion 21 and a spacing (a) exits between the adjacent sector pieces 22. Each sector piece 22 is tilted relative to the intermediate portion 21. As such, when the contacts are in contact with each other, only the intermediate portions 21 will be in contact and the edge portions will not be in contact. Such a configuration would concentrate the electric arc among the section pieces 22 and reduce the electric arc at the intermediate portion 21, thereby reducing the impact of the electric arc on the intermediate portion 21. The inner contact 3 is located within the intermediate portion 21 of the outer contact 2 and is of a cake-like shape. The center of the inner contact 3 is concave inward to reduce the electric arc. An insulating spacing (b) of 5-8 mm is provided between the inner contact 3 and the outer contact 2. The insulating spacing (b) is set to prevent the electric arc of the outer contact 2 from being transferred to the inner contact 3.

As shown in FIG. 1, the conductive connecting piece 1 includes a conductive post 11, a column-like conductive body 12 and a column-like conductive block 13. An inner hole is provided at one end of the conductive body 12, into which the conductive post 11 is inserted. The conductive body 12 is connected with the conductive block 13. The conductive post 11, conductive body 12 and conductive block 13 are coaxial after being connected.

The conductive connecting price 1, inner contact 3 and outer contact 2 are coaxial and the contact surface of the inner contact 3 is on the same plane as that of the outer contact 2. The outer contact 2 is fixed on the conductive block 13 of the conductive connecting piece 1. An axial magnetic field means 4 is covered outside of the conductive connecting piece 1 for generating an axial magnetic field. The axial magnetic field means 4 is fixedly connected with the conductive connecting piece 1. The inner contact 3 is fixed on the conductive connecting piece 1. A circumferential magnetic field means 5 is covered outside of the conductive connecting piece 1 for generating a circumferential magnetic field.

Figure 3:
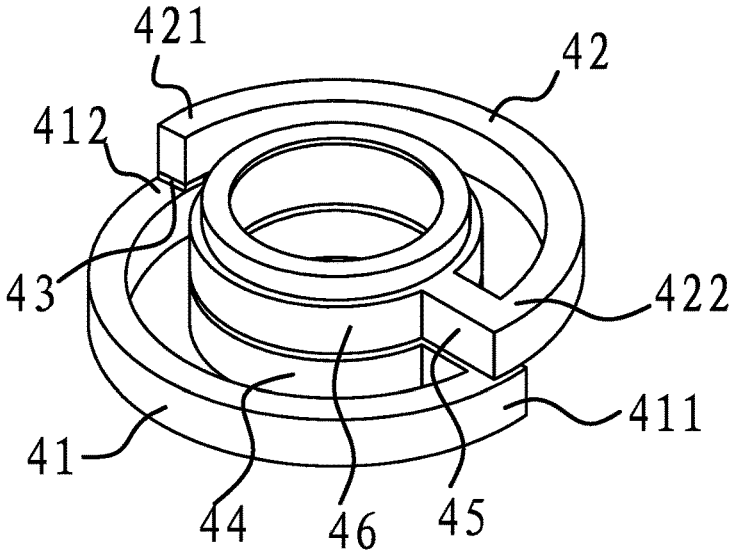
FIG. 3 is a structural diagram of the axial magnetic field means.

In FIGS. 1 and 3, the axial magnetic field means 4 includes a first half ring 41 and a second half ring 42 which is on the same axis as first half ring 41. The first half ring 41 and second half ring 42 are located on the side back to the contact surface of the outer contact 2. The first half ring 41 has a first end 411 and a second end 412. The second half ring 42 has a third end 421 and a fourth end 422. The first end 411 has a connecting tube 44 extending to the axis. The second end 412 is connected to the third end 421 through a connecting block 43. The fourth end 422 of the second half ring 42 has a support section 45 extending to the axis. A support cover 46 is placed on the support section 45. The outer contact 2 is fixed on the support cover 46 through a contact pallet 23 which could increase the structural stability of the outer contact 2 and the conductive capacity. A conductive sleeve 47 is located between the connecting tube 44 and the support cover 46. The conductive body 12 of the conductive connecting piece 1 is inserted and fixed into the connecting tube 44. The connecting tube 44, support cover 46 and conductive sleeve 47 are coaxial with the conductive connecting piece 1. As the first half ring 41 is coaxial with the second half ring 42, these two annular rings form a coil via the connecting block 43. An axial magnetic field will be produced after the current flows through the coil. The first half ring 41 and second half ring 42 are located on the side back to the contact surface of the outer contact 2, so that the axial magnetic line could concentrate on the contact surface of the outer contact 2, further increasing the arc extinguishing capacity of the outer contact 2. The outer contact 2 is connected to the conductive connecting piece 1 via the support cover 46, conductive sleeve 47 and connecting tube 44, so that the outer contact could sustain a large collision force when two contacts are in contact and the axial magnetic field means 4 would not be affected by collision.

A reinforcing plate 14 is fixed on the upper end of the conductive body 12 of the conductive connecting piece 1. The reinforcing plate 14 has an outer circumference supported on the first half ring 41 and a flange 141 engaged with the first half ring 41. The inner circumference of the reinforcing plate 14 is supported on the connecting tube 44. A shield case 15 is fixed on the lower end of the conductive body 12 of the conductive connecting piece 1. A fixing plate 16 is fixed to the conductive post 11 by welding to support the shield case 15. The shield case 15 could screen the electric arc of the contact from transferring to the conductive post 11.

Figure 4:
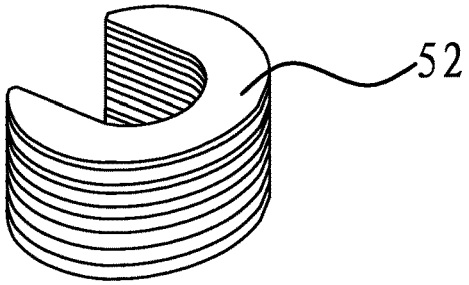
FIG. 4 is a structural diagram of the horseshoe cores in stack according to the first embodiment of the invention.

As shown in FIGS. 1 and 4, the circumferential magnetic field means 5 includes a support frame 51 fixed on the conductive block 13 of the conductive connecting piece 1 and several horseshoe cores 52 placed in the support frame 51. The horseshoe cores 52 are stacked in the axial direction and the openings thereof are aligned with each other in stack. The horseshoe cores 52 are covered outside of the conductive block 13 of the conductive connecting piece 1 and have a spacing from the conductive block 13 of the conductive connecting piece 1. After a large amount of current flows through the conductive connecting piece 1, a circumferential magnetic field centered on the axis of the conductive connecting piece 1 will be generated. The circumferential magnetic forces, after being reinforced by the horseshoe cores 52, will form an oriented circumferential magnetic field which acts on the high-voltage electric arc around the inner contact 3. The stack of the cores could prevent a vortex magnetic field being produced within the magnetic conductive piece.

The support frame 51 includes an outer round tube 511 and an inner round tube 512. A bottom plate 513 is located at the bottom of the outer round tube 511. A cavity is formed between the outer round tube 511 and the inner round tube 512 to stack the horseshoe cores 52. The bottom plate 513 is fixed on the conductive connecting piece 1. The lower end of the inner round tube 512 is fixed on the bottom plate 513 and the upper end thereof is fixed on the conductive connecting piece 1.

The principle of operation of the contact for the high-voltage vacuum arc extinguishing chamber is mentioned as follows. The contact surface between the contacts could be increased by using the outer contact 2 and inner contact 3, which shares a part of the current and reduces the heat generated by the contacts. Secondly, an axial magnetic field is generated by the axial magnetic field means 4 when the vacuum arc extinguishing chamber is closed or opened. A circumferential magnetic field having the axis of the conductive connecting piece 1 as the center, is generated by the circumferential magnetic field means 5. The axial magnetic field covers the outer contact 2 and the inner contact 3 in the meantime. Thanks to the axial magnetic field, the electric arc generated between the moving contact and the fixed contact in the vacuum arc extinguishing chamber will rapidly extinguish in the direction of the magnetic field by means of the magnetic field. Particularly, the electric arc on the contact surface of the outer contact 2 will quickly extinguish. The electric arc produced close to the inner contact 3 will move along the circumferential direction and rapidly extinguish by means of the circumferential magnetic field. As such, the electric arc between the contacts will rapidly extinguish under the intersectional action of the axial and circumferential magnetic fields. The rapid extinction of the high-voltage electric arc further reduces burning of the contacts by the electric arc, thereby reducing the heat of the vacuum chamber.

Second Embodiment

Figure 5:
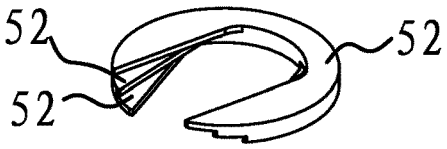
FIG. 5 is a structural diagram of the horseshoe cores in stack according to the second embodiment of the invention.
Figure 6:
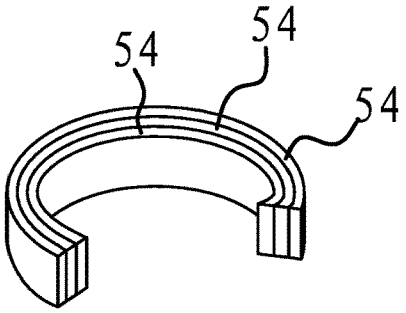
FIG. 6 and FIG. 7 are structural diagrams of magnetic conductive pieces in stack according to the fourth embodiment of the invention.
Figure 7:
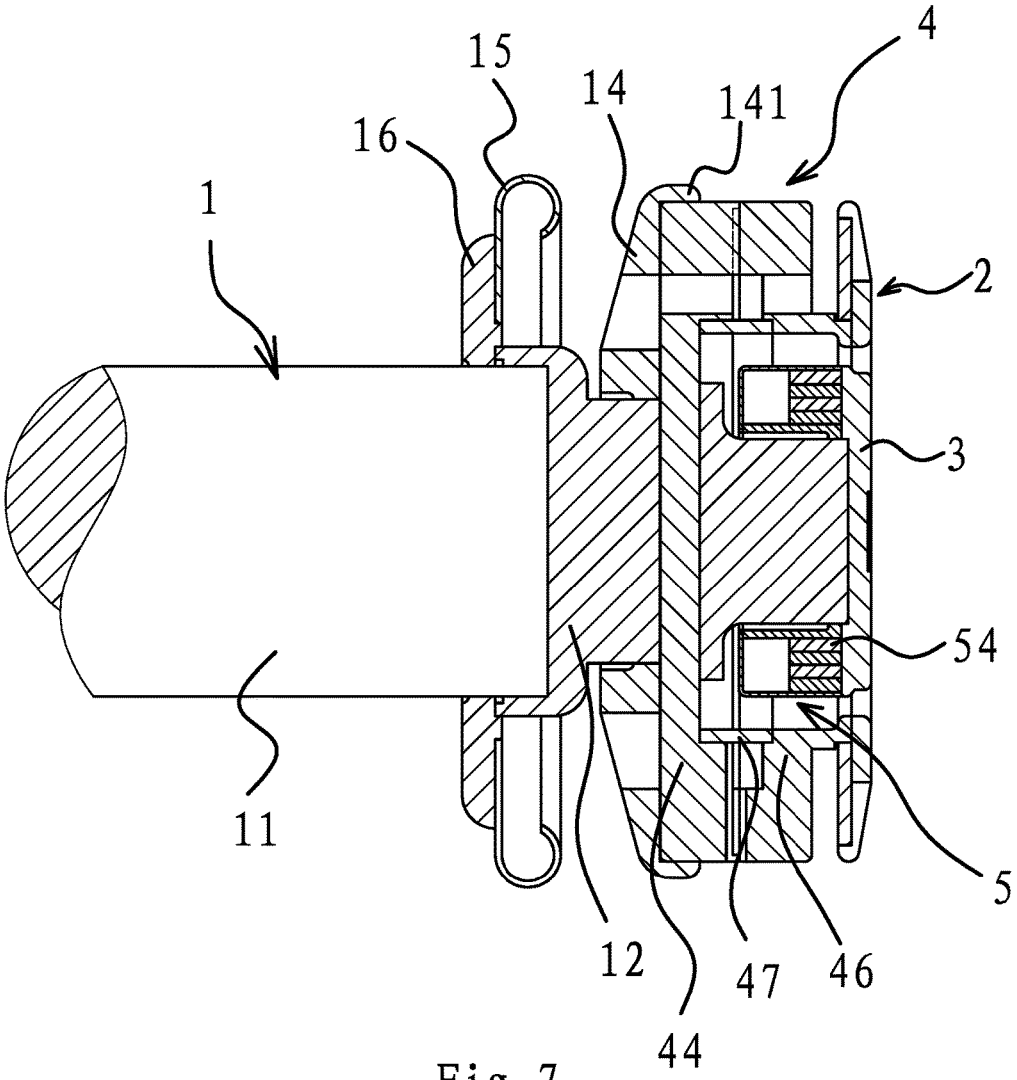

The second embodiment is substantially identical to the first embodiment except that the openings of adjacent horseshoe cores 52 are stacked in the same angle and in the same direction, as shown in FIG. 5. Such an arrangement could speed up extinction of the electric arc. The other aspects are omitted herein for brevity.

Third Embodiment

The third embodiment is substantially identical to the first embodiment except that the openings of a half of the horseshoe cores 52 are aligned on the upper layer and those of the other half are aligned on the lower layer, in which the openings of the upper layer of the horseshoe cores 52 are arranged normal to those of the lower layer of the cores. Four poles, i.e., the ends of the cores, will be formed in the said configuration, which could form an intersectional magnetic field and has a better arc extinguishing effect. The other aspects are omitted herein for brevity.

Fourth Embodiment

The fourth embodiment is substantially identical to the first embodiment except that the circumferential magnetic field means 5 includes a support frame 51 fixed on the conductive connecting piece 1 and several magnetic conductive sheets 54 provided within the support frame 51. The magnetic conductive sheets 54 are bent into horseshoe shapes the sizes of which are gradually reduced, and are stacked in the radial direction of the conductive connecting piece 1. The horseshoe magnetic conductive sheets 54 thus formed are covered outside of the conductive connecting piece 1 and have a spacing from the conductive connecting piece 1. The circumferential magnetic field means 5 thus configured has a stronger magnetic field in the opening direction and has a quicker arc extinguishing effect. The other aspects are omitted herein for brevity.

The embodiments described herein are merely illustrative of the spirit of the invention. It is obvious to those skilled in the art that various variations, supplements or alternatives could be made to these embodiments without departing from the spirit of the invention or the scope defined by the appended claims.

LIST OF REFERENCE NUMERALS

1 conductive connecting piece
11 conductive post
12 conductive body
13 conductive block
14 reinforcing plate
141 flange
15 shield case
16 fixing plate
2 outer contact
21 intermediate portion
22 sector piece
23 contact pallet
a spacing
3 inner contact
b insulating spacing
4 axial magnetic field means
41 first half ring
411 first end
412 second end

42 second half ring
421 third end
422 fourth end
43 connecting block
44 connecting tube
45 support section
46 support cover
47 conductive sleeve
5 circumferential magnetic field means
51 support frame
511 outer round tube
512 inner round tube
513 bottom plate
52 horseshoe core
54 magnetic conductive sheet

What is claimed is:

1. A contact for a high-voltage vacuum arc extinguishing chamber, comprising:

a conductive connecting piece (1);

an annular conductive outer contact (2) fixed on the conductive connecting piece (1);

a conductive inner contact (3) fixed on the conductive connecting piece (1) is located within the annular outer contact (2) and does not contact with the outer contact (2), the conductive connecting piece (1), inner contact (3), and outer contact (2) are coaxial and an outside contact surface of the inner contact (3) is on a same plane as that of the outer contact (2);

an axial magnetic field means (4) having a coil structure capable of generating an axial magnetic field is covered outside of the conductive connecting piece (1), the axial magnetic field means (4) is fixedly connected with the conductive connecting piece (1);

a circumferential magnetic field means (5) located in the axial magnetic field means (4), the circumferential magnetic field means (5) having a plurality of magnetic cores capable of generating and reinforcing a circumferential magnetic field, the circumferential magnetic field means (5) is covered outside of the conductive connecting piece (1);

a support frame (51) of the circumferential magnetic field means (5), the support frame (51) having an outer round tube (511) and an inner round tube (512) made of aluminum;

a cavity is formed between the outer round tube (511) and the inner round tube (512) for stacking horseshoe cores (52); and a plurality of magnetic conductive sheets (54) provided within the cavity of the support frame (51), the magnetic conductive sheets (54) are bent into horseshoe shapes to form the horseshoe cores (52), the horseshoe cores (52) are stacked in a radial direction of the conductive connecting piece (1), sizes of the horseshoe cores (52) are gradually reduced in the radial direction of the conductive connecting piece (1).

2. The contact as claimed in claim 1 wherein the axial magnetic field means (4) includes a first half ring (41) and a second half ring (42) which is on a same axis as the first half ring (41), in which the first half ring (41) has a first end (411) and a second end (412), the second half ring (42) has a third end (421) and a fourth end (422), the first end (411) is connected with the conductive connecting piece, the second end (412) is connected to the third end (421) through a connecting block (43), and the first half ring (41) and the second half ring (42) are located on a back side of a contact surface of the outer contact (2).

3. The contact as claimed in claim 2 wherein the first end (411) has a connecting tube (44), the second half ring (42) has a support section (45), a support cover (46) is placed on the support section (45), the outer contact (2) is fixed on the support cover (46), a conductive sleeve (47) is located between the connecting tube (44) and the support cover (46), the conductive connecting piece (1) is inserted and fixed into the connecting tube (44), and the connecting tube (44), the support cover (46) and the conductive sleeve (47) are coaxial.

4. The contact as claimed in claim 2 wherein the horseshoe magnetic conductive sheets (54) are covered outside of the conductive connecting piece (1) and have a spacing from the conductive connecting piece (1).

5. The contact as claimed in claim 3 wherein a reinforcing plate (14) is fixed on the conductive connecting piece (1), the reinforcing plate (14) has an outer circumference supported on the first half ring (41) and a flange (141) engaged with the first half ring (41), and an inner circumference of the reinforcing plate (14) is supported on the connecting tube (44).

6. The contact as claimed in claim 3 wherein the horseshoe magnetic conductive sheets (54) are covered outside of the conductive connecting piece (1) and have a spacing from the conductive connecting piece (1).

7. The contact as claimed in claim 5 wherein the horseshoe magnetic conductive sheets (54) are covered outside of the conductive connecting piece (1) and have a spacing from the conductive connecting piece (1).

8. The contact as claimed in claim 1 wherein the horseshoe magnetic conductive sheets (54) are covered outside of the conductive connecting piece (1) and have a spacing from the conductive connecting piece (1).

9. The contact as claimed in claim 8 wherein a bottom plate (513) is located at a bottom of the outer round tube (511), the bottom plate (513) is fixed on the conductive connecting piece (1), and a lower end of the inner round tube (512) is fixed on the bottom plate (513) and an upper end thereof is fixed on the conductive connecting piece (1).

* * * * *